United States Patent [19]

Wozney, Jr.

[11] Patent Number: 4,987,720

[45] Date of Patent: Jan. 29, 1991

[54] NON-SKID HOLDER FOR SHINGLES FOR USE ON A PITCHED ROOF

[76] Inventor: John C. Wozney, Jr., 6827 Jerome St., Springfield, Va. 22150

[21] Appl. No.: 483,718

[22] Filed: Feb. 23, 1990

[51] Int. Cl.[5] ..... E04D 15/00; E04F 21/00; E04G 21/14

[52] U.S. Cl. ..... 52/749; 52/DIG. 1; 248/237

[58] Field of Search ..... 52/746, 748, 749, DIG. 1; 108/55.3; 248/237

[56] References Cited

U.S. PATENT DOCUMENTS

| | | | |
|---|---|---|---|
| 1,154,855 | 9/1915 | Gallup | 248/237 |
| 1,661,192 | 3/1928 | Nelson | 248/237 |
| 1,886,921 | 11/1932 | Tobin | 248/237 |
| 2,845,206 | 7/1958 | Currie | 248/237 |
| 3,245,192 | 4/1966 | Hilson | 52/748 |
| 4,043,093 | 8/1977 | Riggs | 52/749 |

*Primary Examiner*—Neill R. Wilson
*Attorney, Agent, or Firm*—Richard P. Matthews

[57] ABSTRACT

A non-skid holder for shingles for use on a pitched roof and method of making it. The holder is made from sheet metal and has one end upturned to a position at right angles thereto in order to guide shingles placed thereon. A handle is secured to the upturned end and to the underside of the metallic sheet. The handle provides additional lateral support for the holder when positioned on a roof in the event of tipping of the holder. The holder is provided with a non-skid undersurface by securing a rubberized or plastic material thereto. Preferably, the non-skid surface material is adhesively bonded to the undersurface of the holder and is wrapped in continuous fashion around the corner between the upturned end and the bottom of the holder. In one form of the invention, the non-skid surface covers the entire bottom surface of the holder and in another form the non-skid surface is applied as strips along the marginal undersurface of the holder. Triangular portions are removed from the upturned end to facilitate easy removal of shingles placed on the holder.

7 Claims, 1 Drawing Sheet

NON-SKID HOLDER FOR SHINGLES FOR USE ON A PITCHED ROOF

This invention related to a holder for shingles and a method of making it and, more particularly, to such a holder which will not slide off a pitched roof.

BACKGROUND OF THE INVENTION

A problem exists in roofing or re-roofing a house in that individual shingles tend to fall off a pitched roof from a stack of shingles before they can be secured to the roof. Therefore, a number of practices have been employed in order to anchor, on a temporary basis, a stack of shingles that are to be applied to a roof structure. One of these practices has been to place paper beneath the stack of shingles. Another practice has been to drive a nail into the roof and later patch the hole left by the nail. Another practice has been to use a roof jack and nail it to the roof. This also requires that the hole left by the nail be patched after removing the roof jack.

SUMMARY OF THE INVENTION

The aforementioned practices have been both ineffective and unsatisfactory. The shortcomings of the known prior art are effectively overcome by the use of the shingle holder of the present invention. The base of the holder is formed from sheet material such as galvanized sheet steel. One end of the sheet is trimmed with a pair of triangular cuts and this end is then bent, such as on a bench press, to provide an upturned end substantially at right angles to the remainder of the sheet. This upturned end provides a guide for a stack of shingles when in position on a pitched roof. A handle is secured to the upturned end and to the underside of the base of the holder. A non-skid surface is provided for the holder by adhesively securing an elastomer foam or rubberized material to the undersurface of the base and extending its securement in uninterrupted fashion to the upturned end portion. This wraparound feature provides better securement and minimizes the tendency of the non-skid surface from separating or delaminating from the base of the holder. This non-skid surface may either take the form of a full width covering for the base of the shingle holder or be in the form of parallel strips of material approximately 2–3 inches vide along the longitudinal marginal edges of the base of the shingle holder.

The inherent advantages and improvements of the present invention will become more readily apparent upon reference to the following detailed description of the invention and by reference to the accompanying drawings wherein.

DETAILED DESCRIPTION OF THE INVENTION

Figure 1:
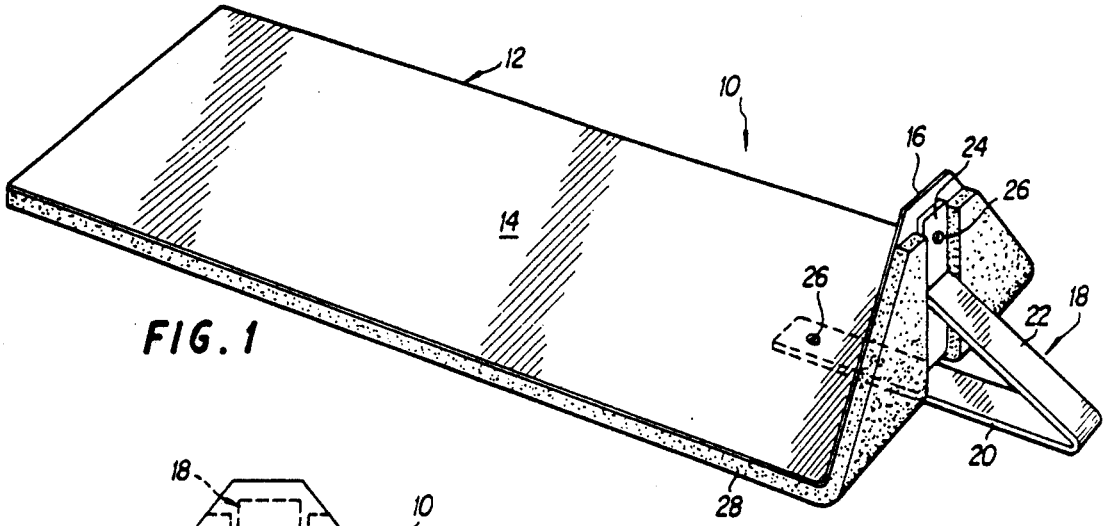
FIG. 1 is a perspective view of the shingle holder of the present invention.
Figure 3:
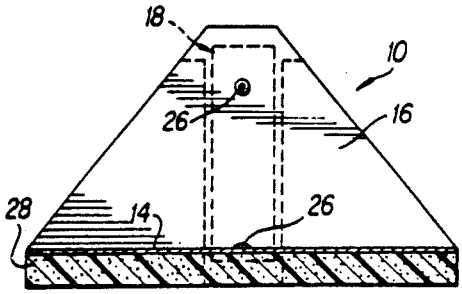
FIG. 3 is an end elevational view taken in vertical cross section along line 3—3 of FIG. 2.
Figure 2:
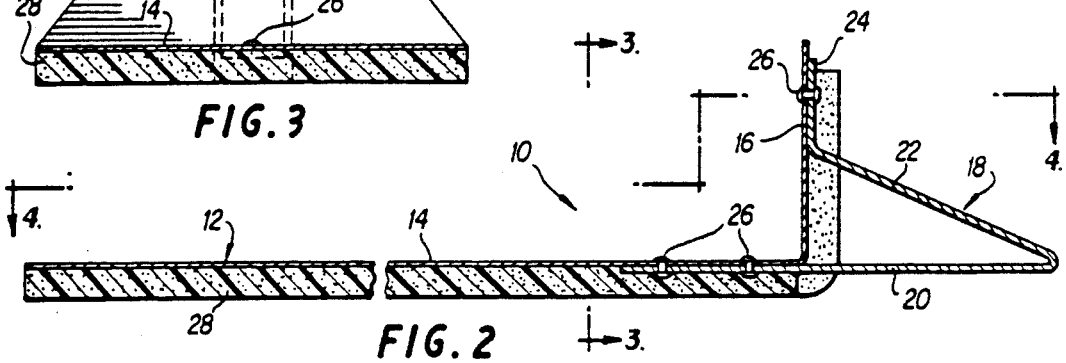
FIG. 2 is a side elevational view of the shingle holder taken in vertical cross section along the longitudinal central axis of FIG. 1.
Figure 4:
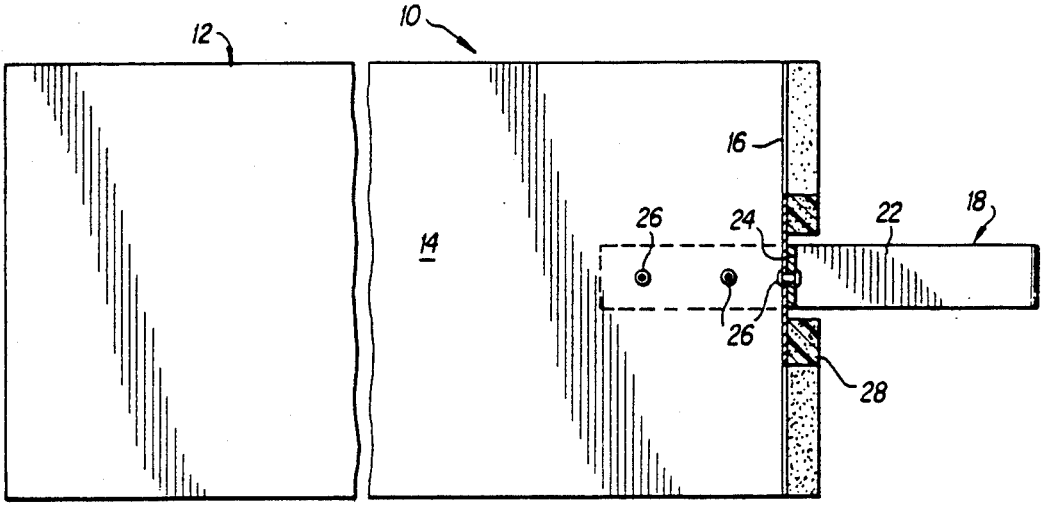
FIG. 4 is a top plan view taken in horizontal cross section along line 4—4 of FIG. 2.

Referring nov to FIG. 1 of the drawings, there is shown a shingle holder indicated generally at 10. The shingle holder is formed from a sheet of galvanized iron indicated generally at 12 which before being formed was twenty-four inches long and eight inches wide. After trimming two triangular portions off of one end, the trimmed end is then bent on a bench press to produce an upturned end portion 16 of about four inches and a base portion of about twenty inches in length. A handle indicated generally at 18 is then constructed from any suitable material such as an aluminum bar $\frac{1}{8}'' \times 1''$ in cross section. Handle 18 is shown to have a horizontally extending portion 20, an upwardly angled portion 22 and a vertically extending portion 24. The horizontally extending portion 20 is secured to base 14 by pop rivets 26 and the vertically extending portion 24 is secured to the upturned end portion 16 by pop rivets 26.

A non-skid surface is then provided for the shingle holder 10 by means of the adhesive securement of a rubberized or elastomer foam material to the undersurface of base 14 and continued uninterrupted in wraparound fashion to the upturned end 16. This non-skid surface 28 may be in the form of strips of material 2–3 inches in width along the longitudinal marginal edges of base 14 which can be visualized from the right hand end of FIG. 1 or the non-skid surface can cover the entire undersurface of base 14. In either form, the non-skid surface extends in uninterrupted wraparound fashion from base 14 to upturned end portion 16 to inhibit the surface from delaminating or separating from the undersurface of the base 14.

In addition to bar stock aluminum, the handle 18 may be formed from other materials. For example, strap metal commonly used in connection with ductwork was used to make some of the early models of shingle holders. By having a horizontally extending portion 20 for handle 18, additional support is provided for the shingle holder against tipping over. The non-skid surface is approximately one-half inch thick so that with a very slight amount of tipping the horizontally extending portion 20 contacts the roof and provides additional stability. While any material having a non-skid relationship with respect to the shingles may be used, one such material that has been used satisfactorily is a product sold under the trademark INSUL-SHEET sheet insulation by Halstead/Nomaco, a division of Halstead Industries, Inc. of Greensboro, N.C. This is an elastomeric, closed cell thermal insulation material and is available in sheet or roll form in $\frac{1}{8}$ inch increments from $\frac{1}{8}$ inch through one inch.

It should also be noted that the bend imparted to the galvanized sheet metal 12 in forming the upturned end 16 should not exceed 90 degrees. If it does exceed 90 degrees, it will interfere with the vertical movement of individual shingles as they are removed sequentially from the pack of shingles. Optionally, the edges of the upturned end 16 may be dipped in plastic to protect the fingers of the installer from a raw edge. Also optionally, the edges of the base 14 remote from the turned up end may be rounded although this is not deemed to be too necessary. The galvanized sheet metal actually used is 28 gauge.

The present invention saves in the time required for installation of shingles by preventing their falling to the ground and from sliding one shingle with respect to another. The placement of the holder on an inclined or pitched roof may be suitably adjusted in accordance with the reaching capability of the installer.

While the invention has been illustrated and described with respect to preferred embodiments thereof, it will be recognized that the invention may be otherwise variously embodied and practiced within the scope of the claims which follow.

I claim:

1. A non-skid holder for shingles for use on a pitched roof which comprises:

a. a base member formed from sheet material having an upturned portion at one end to form a corner with said base member, i. said base member providing a stacking surface for shingles, b. a handle member secured to said upturned portion and to the bottom of said base member, c. and a non-skid member secured to at least a portion of the undersurface of said base member and extending for substantially the entire length of said base member in said secured portions, i. said non-skid member adapted to be placed on a pitched roof surface.

2. A non-skid holder for shingles as defined in claim 1 wherein said non-skid member is wrapped around said base member and said upturned portion.

3. A non-skid holder for shingles as defined in claim 1 wherein said non-skid member covers the entire bottom surface of said base member.

4. A non-skid holder for shingles as defined in claim 1 wherein said non-skid member is applied in strips along the longitudinal marginal edge portions on the underside of said base member.

5. A non-skid holder for shingles as defined in claim 4 wherein said strips are wrapped around the corner formed by said base member and said upturned portion.

6. A non-skid holder for shingles as defined in claim 1 wherein said upturned portion tapers inwardly as it extends upwardly from said base member to facilitate removal of shingles when stacked on said base member.

7. A non-skid holder for shingles as defined in claim 6 wherein said upwardly inwardly tapering edge portions of said upturned end are coated with a plastic material to avoid rough edges thereon.

* * * * *